US005531280A

United States Patent [19]

Steinkamp et al.

[11] Patent Number: 5,531,280

[45] Date of Patent: Jul. 2, 1996

[54] DRILL STRING ANCHOR

[76] Inventors: Manfred Steinkamp, Westwinds, Cammachmore, Kincardine, Aberdeen AB3 2NY, Great Britain; Werner Lau, Grange Lodge, South Avenue, Cults, Aberdeen ABI 9LP, Great Britain; Bruce McGarian, 23 East Glebe, Stonehaven, Aberdeen AB3 2HW, Great Britain

[21] Appl. No.: 397,151

[22] PCT Filed: Aug. 31, 1993

[86] PCT No.: PCT/GB93/01837

§ 371 Date: Jun. 14, 1995

§ 102(e) Date: Jun. 14, 1995

[87] PCT Pub. No.: WO94/05891

PCT Pub. Date: Mar. 17, 1994

[30] Foreign Application Priority Data

Sep. 2, 1992 [GB] United Kingdom ..... 9218568

[51] Int. Cl.[6] ..... E21B 4/18

[52] U.S. Cl. ..... 175/230

[58] Field of Search ..... 175/452, 73, 78, 175/230, 267, 269, 424

[56] References Cited

U.S. PATENT DOCUMENTS

| | | | |
|---|---|---|---|
| 2,546,950 | 3/1951 | Nixon | 166/212 |
| 2,612,346 | 9/1952 | Nelson | 175/230 |
| 2,792,063 | 5/1957 | Jones | 166/212 |
| 3,062,303 | 11/1962 | Schultz | 175/230 |
| 3,138,214 | 6/1964 | Bridwell | 175/230 |
| 3,512,592 | 5/1970 | Kellner | 175/230 |

FOREIGN PATENT DOCUMENTS

| | | |
|---|---|---|
| 477452 | 4/1992 | European Pat. Off. . |
| 945321 | 7/1956 | Germany . |

*Primary Examiner*—Roger J. Schoeppel
*Attorney, Agent, or Firm*—Watson Cole Stevens Davis

[57] ABSTRACT

A drill string anchor for use in a well bore, the anchor having a body, a through bore and a plurality of anchor assemblies, each assembly comprising an anchor member, a piston supported within a body and a biasing means. The piston is initially radially movable in response to an initiating fluid pressure in the through bore causing its movement from a first retracted position to a second extended position in which the piston drives the anchor member into contact with the wall of the well bore. The biasing means acts to provide a force biasing the piston towards the first retracted position.

10 Claims, 1 Drawing Sheet

DRILL STRING ANCHOR

The present invention relates to an anchor for use in a drill string.

Drill strings are subjected to variations in the fluid pressure in the well bore. These variations in pressure can cause any tool mounted on the string to move axially within the bore, and this axial movement can affect the accurate operation of the tool. In particular, if a drill string carrying a cutting tool is caused to expand or contract by changes in fluid pressure, the accuracy of the cutting operation will be impaired. Any unscheduled axial movement of the tool would cause the cutters to trace a spiral path in the well bore. One cause of undesirable tool movement is pulsations in the fluid pressure within the drill string resulting from operation of the mud pumps.

It would therefore be desirable to be able to anchor the drill string at a particular location to prevent axial movement of the tool in the well bore.

Axial movement caused by well bore pressure changes is particularly noticeable on small diameter work strings and coiled tubing. In general, the smaller the diameter of the string, the greater the effect becomes. In order to ensure that a cutting tool will cut successfully and accurately it is clearly necessary to hold the tool against axial movement.

The anchor of the present invention has been developed to endeavour to prevent any axial movement of a drill string at the location of the anchor as fluid pressure in the drill string or annulus is varied. The anchor may be used with any other tool which requires location at a specific depth within a tubing or casing of a well bore.

According to the present invention there is provided a drill string anchor for use in a well bore, the anchor having a body, a through bore and a plurality of anchor assemblies, each assembly comprising an anchor member, a piston supported within the body and a biassing means, the piston being radially movable in response to fluid pressure in the through bore between a first retracted position and a second extended position in which the piston drives the anchor member into contact with the wall of the well bore, and the biassing means acting to provide a force biassing the piston towards the first retracted position.

Preferably the inner face of the piston is exposed to the fluid pressure in the through bore, and the outer face of the piston is toothed to constitute the anchor member. The biassing force may be provided by any suitable means such as a coil spring or belville washers, and in the particularly preferred embodiment is provided by a leaf spring. The leaf spring may be fixed to the body at one end, the other end of the leaf spring engaging the piston.

Preferably, each anchor assembly additionally comprises a stop means for limiting radial extension of the piston. Each anchor assembly may also comprise a bleed passage between the inner and outer faces of the piston and a check valve may fitted to the bleed passage.

In a particularly preferred embodiment of the present invention the anchor has two axially separated sets of anchor assemblies, each set comprising three equiangularly spaced anchor assemblies, the two sets being circumferentially offset by sixty degrees with respect to each other.

The present invention will now be described in more detail with reference to the accompanying drawings, in which.

Figure 1:
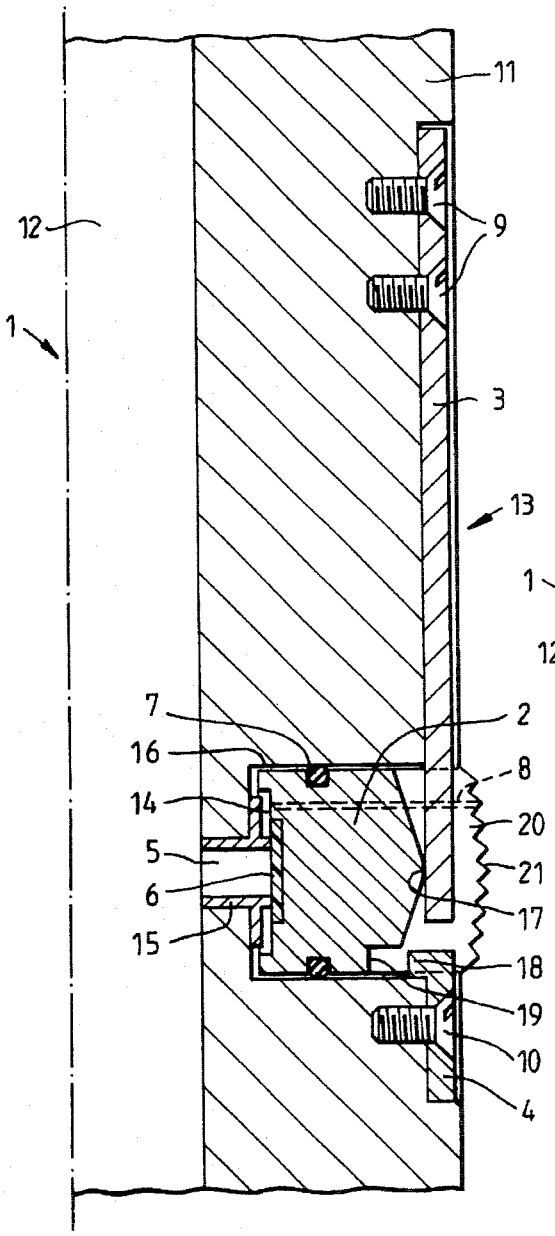
FIG. 1 is a quarter cross-section of an anchor of the present invention showing details of one embodiment of anchor assembly.

Referring first to FIG. 1, an anchor 1 has a body 11, a central through bore 12, and a plurality of anchor assemblies 13. Only one such anchor assembly 13 is shown in FIG. 1. Each anchor assembly comprises a piston 2 movable in a chamber 16, a return spring 3 and a stop 4. A passage 5 allows communication between the through bore 12 and the inner face 14 of the piston. A seat member 6 is provided on the inner face of the piston. A sleeve 15 may be provided as a lining for passage 5, and seat member 6 seals against the sleeve 15 when the piston 2 is in the retracted position.

In FIG. 1 the return spring 3 is shown as a leaf spring which has one end fixed to the body 11 by any suitable means such as screws 9. The other end of the leaf spring rests against an end face 17 of the piston 2 to bias the piston towards the retracted position. The end face 17 is preferably convexly curved to reduce friction and wear between the piston and the leaf spring.

An outer portion 20 extends from the piston 2 and provides a toothed or serrated outer face 21 which constitutes an anchor member. A leakage or bleed passage 8 extends from the inner face 14 of the piston to the outer face 21. The piston is sealed in the chamber 16 by means of a seal assembly 7 such as an O-ring seal.

The stop 4 has an inwardly directed protrusion 18 which is adapted to engage with a shoulder 19 on the piston 2 when the piston is in its extended position, to prevent any further extension of the piston. Stop 4 is fixed to the body of the anchor by any suitable means such as screw 10.

In operation, if pressure within the through bore is increased the internal pressure acts on the seat 6 of piston 2 through passage 5. The pressure thus acts against the biassing force of the spring 3. The passage 5 may have a variable size determined by the size of the aperture in sleeve 15. The size of passage 5 is selected such that the biassing force of the spring 3 is overcome at a particular, selected pressure. The piston 2 then moves radially outwardly in chamber 16, until the outer toothed face 21 contacts and engages with the internal wall of the well bore tubing or casing or the like (not shown). As the piston 2 lifts off sleeve 15, the full area of the inner face 14 of the piston is exposed to the internal pressure in the through bore 12, thus increasing the force exerted by the toothed face 21 on the internal wall of the well bore.

The radially outward movement or stroke of the piston 2 is limited by engagement of the shoulder 19 with protrusion 18 on the stop 4.

When pressure in the through bore 12 drops, the spring 3 returns the piston to its retracted position seated against sleeve 15 by displacing any fluid in the chamber 16 behind the piston out through the leakage passage 8 to the outer face 21 of the piston.

If the piston does not seat fully home in the retracted position once fluid pressure in the bore 12 is reduced, upward movement of the tool would cause the spring to lever the piston home sufficiently to allow the drill string to be withdrawn from the well bore.

By varying the size of passage 5 it is possible to adjust the opening pressure of the tool, the pressure being dependent on the relationship between spring force and the primary piston area, i.e. the area of the seat initially exposed to the pressure in bore 12 when the piston is fully retracted. The secondary piston area, i.e. the area of inner face 14, allows the pressure to develop the outwardly directed force sufficient to hold the drill string against axial movement by means of the tooth formations on outer face 21.

In operation, whilst the piston is held away from its seat against sleeve 15, the pressurised fluid in the bore 12 will bleed off through passage 8, but this passage is sized or restricted such that the fluid flow, and the consequent loss of fluid, are minimised. A miniature check valve (not shown) could if desired be fitted to control the loss of fluid from passage 8, such that when under positive pressure from internal fluid the check valve closes, and at a lower pressure the valve opens when the spring acts to return the piston to its retracted position, allowing fluid to vent via passage 8 from chamber 16.

An anchor according to the present invention is formed with a plurality of anchor assemblies. The preferred embodiment shown in FIG. 2 comprises a first set 22 of anchor assemblies axially spaced from a second set 23 of anchor assemblies on the anchor body 11. Each set of anchor assemblies 22, 23 comprises three anchor assemblies 13 circumferentially spaced at 120 degrees to each other. The first set 22 is circumferentially offset by sixty degrees from the second set 23.

Figure 2:
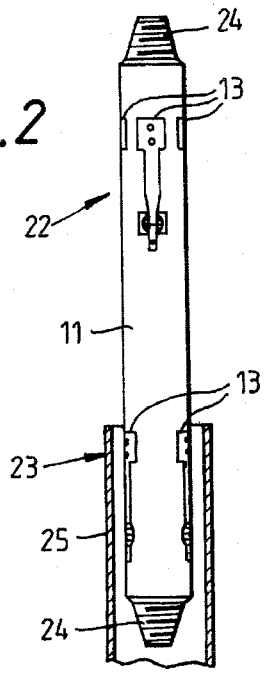
FIG. 2 is a diagrammatic longitudinal view of a preferred embodiment of the anchor.

As shown in FIG. 2, the anchor may be formed as a sub for connection in a drill string, the anchor body 11 having a connection pin or box thread 24 at either end, the drill string being inserted into tubing 25 and being anchored against longitudinal axial movement with respect to the tubing.

Figure 3:
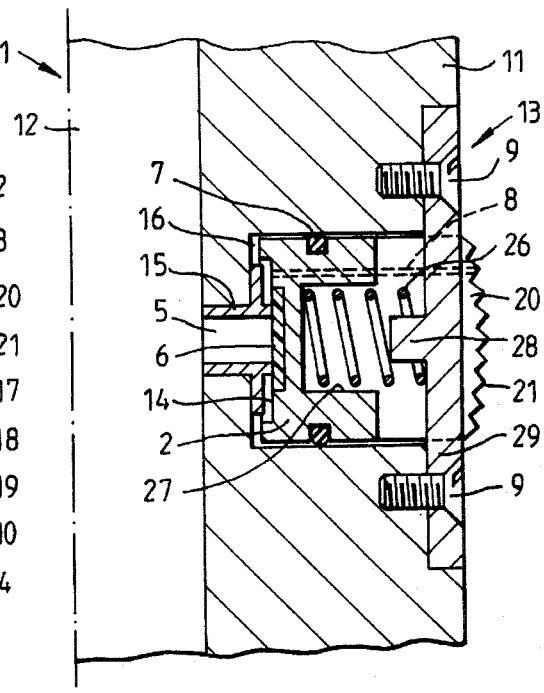
FIG. 3 is a quarter cross-section of an anchor showing details of an alternative embodiment of an anchor assembly.

FIG. 3 shows a similar view to that shown in FIG. 1 and like reference numerals will be used for like parts. In the anchor 1 of FIG. 3, the leaf spring has been replaced by a coil spring 26, Belville washers could be used instead of the coil spring 26. The coil spring is retained in position by means of a recess 27 in the piston 2, and by means of a guide pin 28 on a plate 29 fixed to the anchor body and spanning the width or length of the piston. The coil spring is compressed as the piston is extended under fluid pressure in the bore 12, and once the fluid pressure drops, the coil spring acts to return the piston to the retracted position. The plate 29 also acts as a stop member to prevent extension of the piston 2 beyond the maximum desired position of extension.

The anchor of the present invention is intended particularly for use with small diameter work strings and within small tubing sizes, but its application is not intended to be limited to such small dimension drill strings.

Since the anchor of the present invention supports the drill string and anchors it against movement in the well bore, the drill string should be run with a downhole motor below the anchor to provide the rotation of the cutting tool.

Although the anchor has been described embodied as a separate sub it will be appreciated that the anchor may be provided as part of a tool, for example a cutting tool.

Whilst in the preferred embodiment the anchor members are constituted by the radially outer extremities of the pistons it will be appreciated that separate anchor members in direct or indirect contact with the pistons may be used if desired.

We claim:

1. A drill string anchor for use in a well bore, the anchor comprising: a body (11); a through bore (12); and a plurality of anchor assemblies (13), each assembly comprising an anchor member (21), a piston (2) supported within the body, and a biasing means (3), the piston being radially movable in response to fluid pressure in the through bore between a first retracted position and a second extended position in which the piston drives the anchor member into contact with the wall of the well bore, and the biasing means acting to provide a force biasing the piston towards the first retracted position, wherein the effective area of the piston (2) which is exposed to the fluid pressure in the through bore when the piston is in the first retracted position is smaller than the effective area of the piston which is exposed to the fluid pressure in the through bore when the piston is displaced from the first retracted position.

2. A drill string anchor according to claim 1, wherein the effective piston area when the piston is in the first retracted position is defined by a portion of the inner face (14) of the piston (2) which is exposed to the fluid pressure in the through bore when the piston is in its first retracted position.

3. A drill string anchor according to claim 1, wherein the outer face (21) of the piston (2) is toothed to constitute the anchor member.

4. A drill string anchor according to claim 1, wherein the biasing force is provided by a coil spring (26) or at leaf spring (3).

5. A drill string anchor according to claim 1, wherein the biasing force is provided by Belville washers.

6. A drill string anchor according to claim 4, wherein the leaf spring (3) is fixed to the body at one end, the other end of the leaf spring engaging the piston (2).

7. A drill string anchor according to claim 1, wherein each anchor assembly additionally comprises a stop means (4) for limiting radial extension of the piston (2).

8. A drill string anchor according to claim 1, wherein each anchor assembly also comprises a bleed passage (8) between the inner (14) and the outer (21) faces of the piston (2).

9. A drill string anchor according to claim 8, wherein a check valve is fitted to the bleed passage.

10. A drill string anchor according to claim 1, wherein the anchor has two axially separated sets of anchor assemblies (22,23), each set comprising three equiangularly spaced anchor assemblies (13), the two sets being circumferentially offset by 60° degrees with respect to each other.

* * * * *